US007316411B2

(12) United States Patent
Spanier et al.

(10) Patent No.: US 7,316,411 B2
(45) Date of Patent: Jan. 8, 2008

(54) CHILDREN'S BOARD FOR GLIDING OVER SNOW AND MANUFACTURING METHOD

(75) Inventors: Hervé Spanier, Sallanches (FR); Michel Veillard, Domancy (FR); Denis Bouttie, Passy (FR); Fanny Caspar, Salins-les-Thermes (FR); Claudia Stern, Valbonne (FR); Fabrice Magoni, Voiron (FR); Jean-Paul Alussi, Sallanches (FR); Stéphane Bernard, Sallanches (FR); Marc Rene, Sallanches (FR)

(73) Assignee: Skis Dynastar, Sallanches (FR)

( * ) Notice: Subject to any disclaimer, the term of this patent is extended or adjusted under 35 U.S.C. 154(b) by 0 days.

(21) Appl. No.: 11/010,404

(22) Filed: Dec. 14, 2004

(65) Prior Publication Data

US 2005/0161909 A1 Jul. 28, 2005

(30) Foreign Application Priority Data

Jan. 28, 2004 (FR) ..... 04 50158

(51) Int. Cl.
*A63C 5/00* (2006.01)

(52) U.S. Cl. ..... 280/610; 280/608

(58) Field of Classification Search ..... 280/601, 280/602, 607, 608, 609, 610, 633
See application file for complete search history.

(56) References Cited

U.S. PATENT DOCUMENTS

| | | | | |
|---|---|---|---|---|
| 3,132,874 | A * | 5/1964 | Baudou | 280/610 |
| 3,628,802 | A * | 12/1971 | Hashimoto et al. | 280/610 |
| 3,928,106 | A * | 12/1975 | Molnar | 280/610 |
| 3,933,362 | A * | 1/1976 | Sakuma et al. | 280/610 |
| 3,940,157 | A * | 2/1976 | Sakuma | 280/610 |
| 3,967,992 | A * | 7/1976 | McCaskey et al. | 280/610 |
| 4,115,506 | A * | 9/1978 | Shima | 280/607 |
| 5,016,901 | A * | 5/1991 | Mayr | 280/607 |
| 5,249,819 | A * | 10/1993 | Mayr | 280/602 |
| 5,288,097 | A * | 2/1994 | Pascal et al. | 280/610 |
| 5,294,139 | A * | 3/1994 | Cazaillon et al. | 280/610 |
| 5,299,822 | A * | 4/1994 | Mayr et al. | 280/610 |
| 5,499,836 | A * | 3/1996 | Juhasz | 280/602 |
| 5,501,825 | A * | 3/1996 | Jodelet | 280/610 |
| 5,544,908 | A * | 8/1996 | Fezio | 280/610 |
| 5,687,983 | A * | 11/1997 | Feketa et al. | 280/609 |
| 5,884,934 | A * | 3/1999 | DeRocco et al. | 280/607 |
| 5,948,472 | A * | 9/1999 | Lawrie | 280/610 |
| 6,082,747 | A * | 7/2000 | Parmentier | 280/609 |
| 6,158,747 | A * | 12/2000 | Magnani | 280/11.14 |
| 6,641,162 | B2 * | 11/2003 | Allmann et al. | 280/607 |
| 6,783,145 | B2 * | 8/2004 | Deborde et al. | 280/607 |
| 2005/0212257 | A1 * | 9/2005 | Deborde et al. | 280/601 |

FOREIGN PATENT DOCUMENTS

| | | | |
|---|---|---|---|
| DE | 1 220 770 | | 7/1966 |
| DE | 2 127 330 | A | 12/1972 |
| DE | 3236016 | A1 | 4/1984 |
| EP | 1004335 | A2 * | 5/2000 |

* cited by examiner

*Primary Examiner*—Hau Phan
(74) *Attorney, Agent, or Firm*—Browdy and Neimark, PLLC

(57) ABSTRACT

A board for gliding over snow, more particularly for children, includes a structure made of just one homogeneous material of an injected thermoplastic polymer, two metal side edges with wings, bordering the bottom surface forming the gliding surface. The structure includes a top surface and a bottom surface forming a gliding surface, and defines a hollow volume. The wings of the metal side edges are embedded in the homogeneous material of an injected thermoplastic polymer material of the structure.

14 Claims, 1 Drawing Sheet

CHILDREN'S BOARD FOR GLIDING OVER SNOW AND MANUFACTURING METHOD

The invention relates to a board for gliding over snow, more particularly for young children to practise alpine skiing. The present invention also relates to a method for manufacturing a board for gliding of this type.

Generally speaking, the skis used by young children, for example those aged between 3 and 6 years, typically have a length of between 60 cm and 100 cm. Given their low weight, limited strength and lack of skiing experience, children need lightweight skis with a high level of flexibility and good stability.

Skis for children have to be relatively flexible in order to facilitate bending and consequently curving of the ski for turning, which bending is generally the result of the child's weight and the acceleration he or she achieves. The stability of children's skis is obtained by making them wider, so as to reduce the tendency to rock from one edge to the other. In this way, good stability will be obtained with skis having a maximum waist width of 70 mm. Lastly, children have to be able to carry their own pair of skis when they arrive at the winter-sports resort and in order to access mechanical ski lifts. This means that the manufacturer has to produce children's skis that are particularly light in weight.

Furthermore, given that children grow quickly, parents do not necessarily wish to purchase a pair of skis. They usually rent them on each trip. Rental outlets therefore seek a reliable product for their youngest clients, one that will last from season to season and will rapidly pay its way.

Prior Art

Manufacturers have proposed toys in the form of ski-boards, which are produced by injection of a polymer material, such as polystyrene. These toys have a running surface forming a substantially planar surface that acts as a gliding surface, a top surface to which the child's boot may be fastened and a filled zone defined between the running surface and the top surface.

However, these toys have no technical characteristics and none of the mechanical performance that children's boards specifically need. Thus, for example, there are no edges. This gives rise to very rapid wear of the toy and even to its breakage during use, which may prove to be very dangerous if the child has picked up speed on a slope.

These products are quite unsatisfactory, even for starting to learn alpine skiing, involving snow-ploughing and the execution of slow turns on a gentle gradient.

It is, furthermore, known to produce alpine skis with a hollow core.

SUMMARY OF THE INVENTION

A principal problem that the invention proposes to solve consists in providing, for a board for gliding over snow intended for children, a construction that makes it possible to obtain flexibility, stability and lightness of the weight while still ensuring a degree of ease of gliding.

Another problem consists in developing a method for producing a board for gliding over snow that is not only simple to implement but also inexpensive.

The invention thus relates to a board for gliding over snow, more particularly for children, comprising:

- a running surface forming a bottom-surface element, bordered by two metal side edges with wings;
- a top surface; and

- a core defined between the running surface and the top surface, produced by injection of a thermoplastic polymer material, said core having a hollow volume.

In accordance with one aspect of the present invention, the board for gliding over snow is characterized:

- in that the running surface forming the bottom-surface element is produced with the polymer material of the core, and
- in that the wings of the metal side edges are embedded in said polymer material of the core and of the running surface forming the bottom-surface element.

In other words, just one homogenous material will form not only the bottom-surface element but also the core. Moreover, a board for gliding of this type will resemble an adult's ski but will still be particularly light in weight owing to its hollow structure, which replaces a completely solid core. Lastly, by incorporating the edges into the same material as forms the board, the board will have enhanced strength owing to the absence of discontinuities between the various component parts of the board. The board will resemble a profiled section with a central opening, which will increase its solidity.

The hollow volume of the core may favourably extend transversely, substantially with a central position relative to the median longitudinal axis of the board. Equally favourably, the hollow volume of the core may extend substantially from the forward contact line as far as the rear contact line of the board.

In a first embodiment, the top surface and the running surface forming the bottom-surface element may be produced with the polymer material of the core. In order to produce a board having attractive and aesthetic characteristics, and in a second embodiment, the top surface may comprise a protective and decorative upper element. This upper element may be formed by a pre-decorated film.

The top surface and the core may advantageously comprise holes. These holes may be made in the waist of the board for gliding. These holes may be intended for mounting the binding elements for securing a boot of a user, i.e. the child, to the board for gliding. The holes may be blind holes. In such a case, protuberances, produced with the polymer material of the core and of the running surface and corresponding to each of the blind holes, project into the hollow volume of the core.

Advantageously, the polymer material may be chosen, alone or as a mixture, from the group comprising polyolefins, such as polyethylenes and polypropylenes, polyurethanes, polyamides, styrenes or any other injected thermoplastic materials.

In accordance with a second aspect of the present invention, a method for manufacturing a board for gliding over snow, more particularly for children, is characterized in that it comprises, in particular, the steps that consist in:

- positioning two metal side edges along the two edges of a mould base;
- closing the mould base with a cover;
- injecting a thermoplastic polymer material in order simultaneously to form a running surface forming a bottom-surface element, a top surface and a core; and
- injecting a pressurized gas, before cooling of the thermoplastic polymer material, in order to form a hollow volume inside the core and the walls of the board around the hollow volume.

The method may advantageously comprise a supplementary step consisting in positioning a pre-decorated film forming a protective and decorative upper element, before the step consisting in closing the mould base with a cover.

Particularly favourably, the method may comprise a supplementary step consisting in forming holes in the top surface and the core. These holes may be obtained, during the step consisting in injecting a thermoplastic polymer material, by means of studs produced on the inner face of the mould cover. The thermoplastic polymer material will be able to harden around these studs, giving rise to protuberances that can project into the hollow volume.

BRIEF DESCRIPTION OF THE FIGURES

The invention will be properly understood and its various advantages and different characteristics will become more apparent from the following description of the non-limiting illustrative embodiment, with reference to the appended diagrammatic drawings, in which.

DETAILED DESCRIPTION OF THE INVENTION

Figure 1:
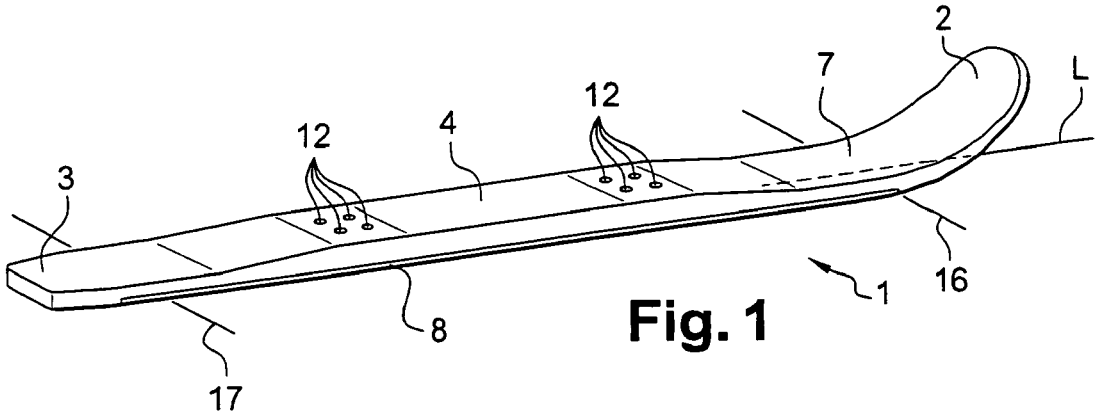
FIG. 1 shows a top perspective view of a children's ski.

As FIG. 1 shows, a board for gliding over snow of conventional type for children, such as an alpine ski (1), comprises a front zone with a shovel (2), a rear zone with a tail turn-up (3), and a central zone known as the waist (4).

The ski (1), for example of shell form, comprises a running surface forming a bottom-surface element (6) and a top surface (7) forming the upper part of the ski (1). The bottom-surface element (6) is delimited on either side by the two side edges (8). In the case of this ski (1) for young children, the bottom-surface element (6) may comprise rear-slip prevention means (not shown), for example in the form of very small scales oriented so as to prevent children from moving off backwards when they have not yet mastered their gliding technique. The top surface (7) may be formed with a protective and decorative upper element (not shown).

Figure 2:
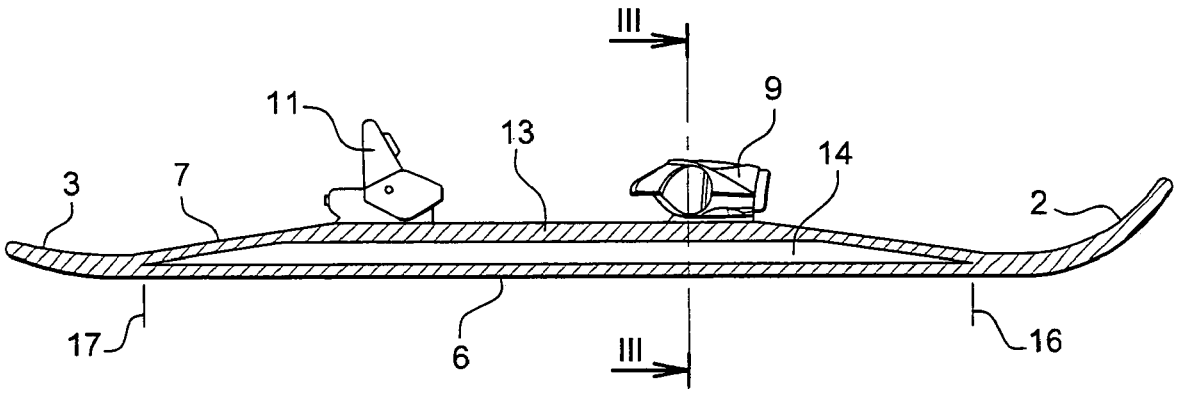
FIG. 2 shows a longitudinal sectional view of the ski of FIG. 1 provided with binding elements.

As FIG. 2 more particularly shows, the ski (1) comprises, at its waist (4), the two binding elements for securing the child's boot to the ski (1), namely the front stop (9) and the rear heelpiece (11). The front stop (9) and the rear heelpiece (11) are firmly held on the ski (1) by anchoring screws (not visible) The screws are housed in holes (12) made beforehand in the top surface (7) of the ski (1).

Figure 3:
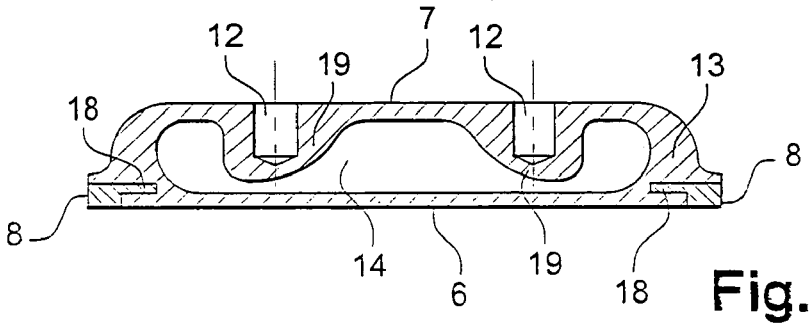
FIG. 3 shows a transverse sectional view of the ski in the plane III-III of FIG. 2.

The ski (1) has an internal structure formed by a core (13). As FIGS. 2 and 3 show, and in accordance with the invention, the running surface forming the bottom-surface element (6) of the ski (1) is produced with the same material as the core (13). Gliding performance levels for a children's ski (1) are not the same as those required for junior and adult skis.

As FIGS. 2 and 3 show, the top surface (7) forming the upper zone and the side faces of the ski (1) are also produced with the same material as the core (13). Owing to the presence of the hollow volume (14), the material of the top surface (7) forms a genuine bridge between the two side edges (8). Therefore, only the two side edges (8) form two pieces, made from a heterogeneous material relative to the rest of the material and the structure of the ski (1). However, in a variant embodiment, an upper element for decorating and protecting the top surface (7) may be provided by being attached during manufacture of the ski (1).

In the invention, the core (13) of the ski (1) comprises a hollow volume (14) delimited by the walls of the ski (1). This hollow volume (14) extends, without discontinuity, over the entire length of the ski (1), from the forward contact line (16) as far as the rear contact line (17). The shovel (2) and the tail turn-up (3) will be solid. By way of example, the length of the hollow volume (14) will be approximately 45 cm for a ski (1) having a length of 70 cm.

Between the forward contact line (16) and the rear contact line (17), the hollow volume (14) extends, without discontinuity, over the entire width of the ski (1), in a centered manner relative to the median longitudinal axis (L) of the ski (1). However, in order to allow sufficient material for cohesion and strength of the ski (1), the size of the hollow volume (14) will be limited transversely.

Between the forward contact line (16) and the rear contact line (17), the hollow volume (14) extends, without discontinuity, over the entire width of the ski (1), in a centred manner relative to the median longitudinal axis (L) of the ski (1). However, in order to allow sufficient material for cohesion and strength of the ski (1), the size of the hollow volume (14) will be limited transversely.

In accordance with the invention, to ensure firm, definitive integration to prevent any tearing-away of the two side edges (8), the material of the core (13) of the ski (1) will completely cover and encapsulate the inner wings (18) of the edges (8), and they will project into the ski (1) and thus into the core (13). The hollow volume (14) extends, at the waist (4), over a width of approximately 6 cm for a ski (1) having a waist width of 8 cm.

In an advantageous embodiment, the material of the core (13) completely surrounds each of the holes (12) provided for receiving the screws of the binding element (9 and 11), forming a protuberance (19). The material of the protuberance (19) lies around the globally cylindrical part and closes off the bottom of the holes (12) and returns inside the hollow volume (14) towards the running surface (6). This will provide continuity of material for the protuberances (19), the running surface forming the bottom-surface element (6), the core (13) and even the top surface (7).

The presence of material at this level of the holes (12) will render them blind. Thus, the holes (12) do not open out into the hollow volume (14). ISO standard 8364, which requires skis to have sufficient thickness to allow holes 7.5 mm deep to be drilled for installing the binding-connection screws, is complied with.

The core (13) is produced with one or more injected thermoplastic polymer materials. A method for manufacturing the ski (1) comprises a number of steps, in which, firstly, the two edges (8) are placed laterally in the base of a mould. As appropriate, a protective and decorative upper element is placed on top. Lastly, the mould cover is closed.

Thermoplastic polymer material will then be injected, this constituting not only the bottom-surface element (6), but also the core (13) and even the top surface (7) if there is no protective and decorative upper element. The polymer is preferably an injected thermoplastic material, such as a polypropylene, polyethylenes, polyurethanes, polyamides, styrenes or any other injectable thermoplastic materials also providing good results.

The step immediately after this, prior to cooling and hardening of the thermoplastic polymer material, is the injection of pressurized gas, via the same injection orifice, in order to form the hollow volume (14). The gas will push back the polymer material and press it against the mould, thereby forming the walls of the ski (1) around the hollow volume (14). Upon completion, the children's ski (1) will be removed from the mould and trimmed.

The orifices (12) present on the top surface (7) will be obtained by means of studs positioned on the inner face of the mould cover. The injected thermoplastic material will flow around the studs and form the protuberances (19) associated with the holes (12).

The present invention is not limited to the embodiments described and illustrated. A number of modifications may be made without thereby departing from the context defined by the scope of the set of claims.

The invention claimed is:

1. A board for gliding over snow for children, comprising:

a structure made or just one homogeneous material of an injected thermoplastic polymer, the structure comprising:

a top surface (7); and a bottom surface forming a gliding surface (6), and a hollow volume (14) defined in and directly by the structure between the bottom surface forming the gliding surface (6) and the top surface (7), and two metal side edges (8) with wings (18), bordering the bottom surface forming the gliding surface (6), wherein the wings (18) of the two metal side edges (8) are embedded in the homogeneous material of the injected thermoplastic polymer.

2. The board according to claim 1, wherein the hollow volume (14) of the structure extends transversely, substantially with a central position relative to the median longitudinal axis (L) of the board (1).

3. The board according to claim 2, wherein the hollow volume (14) of the structure extends longitudinally, substantially from the forward contact lines (16) as far as the rear contact line (17) of the board (1).

4. The board according claim 2, wherein the top surface (7) and the bottom surface forming the gliding (6) are produced with the homogeneous material of an injected thermoplastic polymer of the structure.

5. The board according to claim 4, wherein the top surface (7) and the structure comprise holes (12) made at the waist (4) and intended for the mounting of the binding elements (9, 11) that secure a user's boot to the board (1).

6. The board according to claim 1, wherein the hollow volume (14) of the structure extends longitudinally, substantially from the forward contact line (16) as far as the rear contact line (17) of the board (1).

7. The board according to claim 1, wherein the top surface (7) comprises a protective and decorative upper element formed by a pre-decorated film.

8. The board according to claim 1, wherein the top surface (7) and the structured comprise holes (12) made at the waist (4) and intended for the mounting of binding elements (9, 11) that secure a user's a boot to the board (1).

9. The board according to claim 8, wherein the holes (12) are blind holes, and further comprising protuberance (19), produced, produced with the homogeneous material of an injected thermoplastic polymer of the structure and of the bottom surface forming a gliding surface (6) and corresponding to each of the blind holes (12), project into the hollow volume (14).

10. The board according to claim 1, wherein the homogeneous material of an injected thermoplastic polymer is selected from the group comprising polyolefins including polyethylenes and polypropylenes, polyurethanes, polyamides, styrenes, any other injected thermoplastic material, and mixtures thereof.

11. The board according to claim 1, wherein the top surface (7) comprises a protective and decorative upper element formed by a pre-decorated film.

12. The board according to claim 11, wherein the top surface (7) and the structure comprise hoses (12) made at the waist (4) and intended for the mounting of the binding elements (9, 11) that secure a user's boot to the board (1).

13. The board according to claim 12, wherein the holes (12) are blind holes, and further comprising protuberances is, produced with the homogeneous material of an injected thermoplastic polymer of the structure and of the bottom surface forming the gliding surface (6) and corresponding to each of the blind holes (12), project into the hollow volume (14).

14. The board according to claim 13, wherein the homogeneous material of an injected thermoplastic polymer is selected, from the group comprising polyolefins, polyurethanes, polyamides, styrenes, and mixtures thereof.

* * * * *